United States Patent [19]

Cameron et al.

[11] Patent Number: 5,060,391

[45] Date of Patent: Oct. 29, 1991

[54] BORESIGHT CORRELATOR

[76] Inventors: Jeffrey A. Cameron, 2808 Montrose Dr., SW., Decatur, Ala. 35601; Deborah L. Fraley, 119 Steele Dr., Madison, Ala. 35758

[21] Appl. No.: 661,882

[22] Filed: Feb. 27, 1991

[51] Int. Cl.[5] ..... F41G 1/54; G01B 11/26

[52] U.S. Cl. ..... 33/234

[58] Field of Search ..... 33/234, 235, 227, 228, 33/645, 533; 356/138, 140, 153

[56] References Cited

U.S. PATENT DOCUMENTS

| | | | |
|---|---|---|---|
| 3,782,832 | 1/1974 | Hacskaylo | 33/234 X |
| 4,530,162 | 7/1985 | Forrest et al. | 33/228 |
| 4,879,814 | 11/1989 | Wallsee et al. | 33/234 |

*Primary Examiner*—Harry N. Haroian

*Attorney, Agent, or Firm*—Phillips & Beumer

[57] ABSTRACT

A simple and compact device is disclosed for enabling the boresight alignment of the bore and optical sight of a firearm. An optical assembly, beam splitter, and illumination source assembly are integrated into an enclosure. The firearm bore is referenced mechanically to the enclosure. The illumination source provides visible light which is directed by the beam splitter into the firearm bore. The bore is illuminated from the muzzle to the chamber. This is observed when viewed through the firearm optical sight. Azimuth and elevation adjustments are made in order to bring the images of the muzzle and chamber into coincident alignment. Once this is accomplished, the cross hair of the firearm optical sight is adjusted to bring the cross hair into alignment with the muzzle, bore, and chamber images. The bore and optical sight are boresighted.

22 Claims, 3 Drawing Sheets

BORESIGHT CORRELATOR

FIELD OF THE INVENTION

This invention relates generally to apparatus for boresighting a firearm and more particularly to a boresighting device which is compact and does not require the insertion of any external elements into the bore or chamber of the firearm.

BACKGROUND OF THE INVENTION

A wide variety of boresighting devices has been developed to facilitate proper alignment of a firearm scope or sight. Many such boresighting devices typically require the mechanical attachment of some external members to the barrel or chamber of the firearm to accomplish the boresighting task. U.S. Pat. No. 4,530,162, issued July 23, 1985, to Forrest et al., is typical of such attachment devices and discloses a light source which must be attached to the chamber for directing a collimated beam through the barrel. Additionally, a muzzle insert is provided in the barrel to cooperate with the light source to facilitate the boresight alignment.

There are other boresighting schemes which utilize a source of light which must be precisely mounted in the chamber. The light source must be properly aligned with the bore to direct a beam of light to a target which is used in the boresighting procedure. U.S. Pat. No. 3,782,832, issued on Jan. 1, 1974, to Hacskaylo, discloses such structure.

Applicants provide a boresighting device which overcomes the requirements for external members such as canisters, light-emitting devices, or optical members being placed in the bore or chamber of the firearm and then removed after the boresighting is completed.

SUMMARY OF THE INVENTION

A boresight device according to the present invention includes an optical assembly, a beam splitter, and an illumination source assembly. Light generated by the illumination source assembly is directed via the beam splitter assembly into the firearm bore. Thus, the bore is illuminated from the muzzle through the entire bore length to the chamber. An observer looking into the firearm optical sight would see an image of the muzzle, entire bore length, and chamber. The observer then adjusts the firearm in azimuth and elevation until the observed images are brought into coincidence.

It is, therefore, an objective of the present invention to provide an improved device for boresighting a firearm.

It is another objective of the present invention to provide a small, lightweight, inexpensive, and simple-to-use boresight capability for firearms.

It is a further objective of the present invention to provide a boresight device which is mobile, rugged, and durable.

Additional objectives, advantages, and characteristic features of the invention will become apparent from the following detailed description of a preferred embodiment of the invention when considered in conjunction with the accompanying drawings and appended claims.

DESCRIPTION OF THE PREFERRED EMBODIMENT

Figure 1:
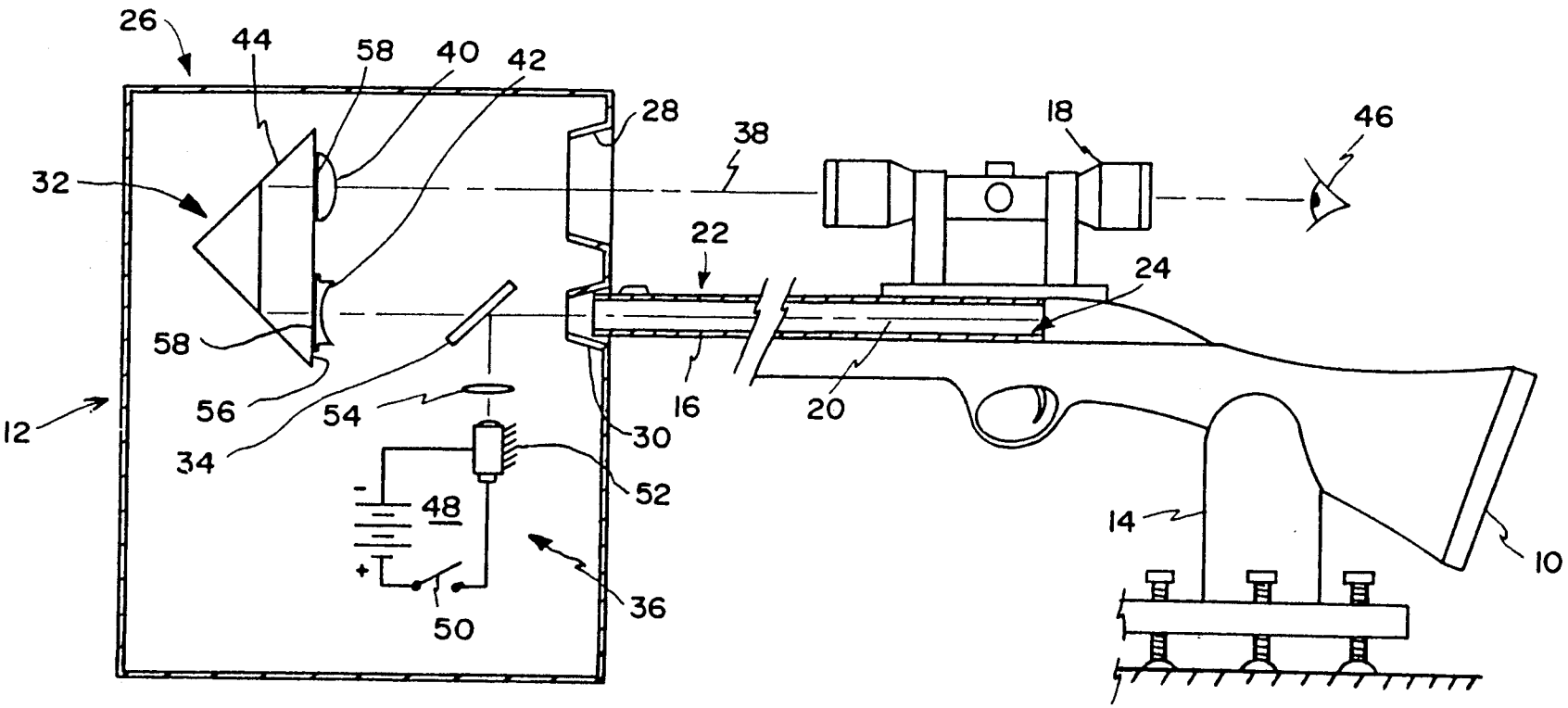
FIG. 1 is a diagrammatic illustration of the boresight correlator and firearm.

Referring to FIG. 1, a firearm 10 is configured in the boresight position with respect to boresight correlator 12. A stock alignment fixture 14 provides azimuth and elevation adjustment for the firearm. Firearm 10 includes a barrel 16 and an optical sight 18. Barrel 16 has a bore 20 having a muzzle end 22 and a chamber end 24. Boresight correlator 12 is comprised of an enclosure 26 having two openings, the sight port 28 and alignment bezel 30, an optical assembly 32, beam splitter 34, and illumination source assembly 36.

The enclosure provides a packaging envelope for the internal components as well as an optical interface for optical sight 18 by means of sight port 28 and a mechanical interface for muzzle end 22 by means of alignment bezel 30. Alignment bezel 30 preferably is provided with a tapered configuration (funnel-shaped, etc.) and made of magnetic material so that when the muzzle is placed in the bezel, the firearm is held therein by the magnetic nature of the bezel.

Figure 2:
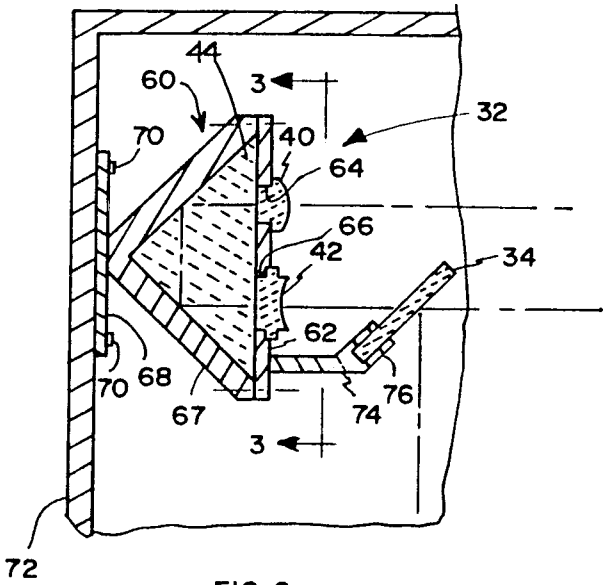
FIG. 2 is a partial elevational sectional view of the device of FIG. 1 showing one way of mounting the prisms in the enclosure.

As shown in FIGS. 1 and 2, optical assembly 32 is comprised of a plano convex lens 40, a plano concave lens 42, and a light directing and receiving means such as a right angle prism 44. Plano convex lens 40 and plano concave lens 42 are secured to the right angle prism 44 in a manner described hereinbelow. Optical assembly 32 provides an optical means whereby an observer 46 can view the muzzle end 22, bore 20, and chamber end 24 of firearm 10 along the optical line of sight 38.

Beam splitter 34 directs visible light from illumination source assembly 36 into bore 20 of firearm 10. Visible light which is scattered from muzzle end 22, walls of bore 20, and chamber end 24 passes through beam splitter 34 and enters optical assembly 32.

Illumination source assembly 36 includes a battery 48, or other suitable power source, a switch 50, a light source 52, and a lens 54. When switch 50 is closed, light source 52 is activated and emits visible light. Lens 54 collimates the visible light from light source 52, thus forming a collimated beam of visible light. The collimated beam of light is directed toward beam splitter 34.

As shown in FIG. 1, lenses 40 and 42 may be secured to face 56 of prism 44 by an epoxy 58 having a matching index of refraction to that of the prism. Such glues are well known in the art.

Figure 3:
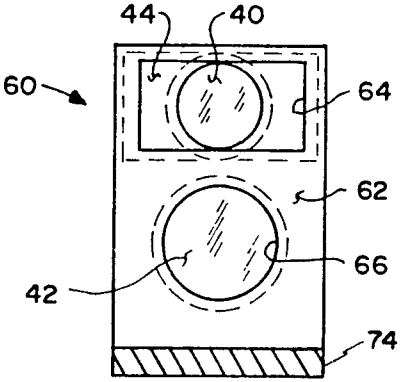
FIG. 3 is an elevational view of the support bracket of FIG. 2 taken along line 3–3 of FIG. 2.

FIGS. 2 and 3 are views illustrating an embodiment of the invention wherein a bracket 60 mounts prism 44 and lenses 40 and 42 in enclosure 26. Bracket 60 includes a forward support member 62 having openings 64 and 66 therein, and an angular support member 67 extends from support member 62. Lenses 40 and 42 may be held in openings 64 and 66 by gluing or any other convenient means. Angular support member 67 may be secured or made integral with a back plate 68 which is secured, for example, by screws 70 to the rear wall 72 of enclosure 26.

Bracket 60 further includes an extending arm portion 74 having a bifurcated beam splitter support element 76 on the distal end thereof. Beam splitter 34 may be held on arm portion 74 by screws (not shown) by gluing or any of many other fastening means. The bracket is manufactured so that no misalignment can occur between the optical components.

In operation, boresight correlator 12 and firearm 10 are positioned in the boresighting configuration as shown in FIG. 1. Muzzle end 22 of firearm 10 is inserted into alignment bezel 30. The magnetic nature of alignment bezel 30 secures muzzle end 22 substantially in normal relation with face 56 of prism 44. Stock alignment fixture 14 is positioned under the stock of firearm 10. Illumination source assembly 36 is activated by switch 50, and collimated visible light is directed by beam splitter 34 into bore 20 of firearm 10. Scattered visible light from muzzle end 22, walls of bore 20, and chamber end 24 passes through beam splitter 34 and enter optical assembly 32. Optical assembly 32 relays the visible light through sight port 28.

An observer 46 looking through optical sight 18 will observe the visible light transmitted through sight port 28. The visible light contains the images of muzzle end 22, walls of bore 20, and chamber end 24. The observer 46 will see the images and adjust the stock alignment fixture 14 is azimuth and elevation until the images of muzzle end 22, walls of bore 20, and chamber end 24 is coincident.

The cross hair of optical sight 18 is then adjusted (if necessary) until the cross hair center coincides with the coincident images. Optical sight 18 and bore 20 of firearm 10 are now boresighted parallel. Optical sight 18 can be adjusted to a specific range based upon the type of ammunition round used and readily available ballistic tables from local sporting goods stores.

Figure 4:
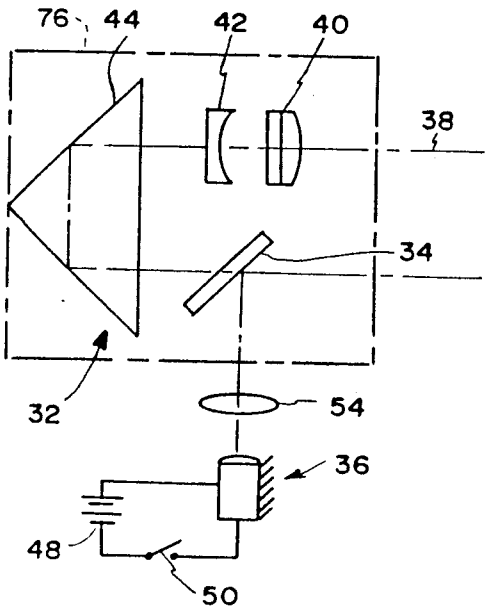
FIG. 4 is a diagrammatic illustration of an alternate embodiment of the boresight correlator shown in FIG. 1.

An alternate embodiment of the invention is illustrated in FIG. 4. In this embodiment, lenses 40 and 42 are shown in a support member 76. Support member 76 may be a bracket having any of many various configurations. Bracket 76 is suitably mounted in housing 26 of correlator 12. Lenses 40 and 42 are mounted in spaced relation along the line of sight (axis) 38 of optical sight 18 (not shown in FIG. 4). In operation, firearm 10 and boresight correlator 12 are positioned as shown in FIG. 1 and described, supra. The reflected images of the muzzle, bore, and chamber are directed into prism 44 and directed through lenses 42 and 40 and into the optical sight. The observer 46 will observe the visible light transmitted through sight port 28 and adjust stock alignment fixture 14 in azimuth and elevation until the images of muzzle end 22, walls of bore 20, and chamber 24 are coincident. The cross hair of optical sight 18 is then adjusted until it coincides with the coincident images.

It is to be understood that although the collimating lens 42 is described as being plano convex, the invention is not to be so limited since this lens may be concave or convex.

Figure 5:
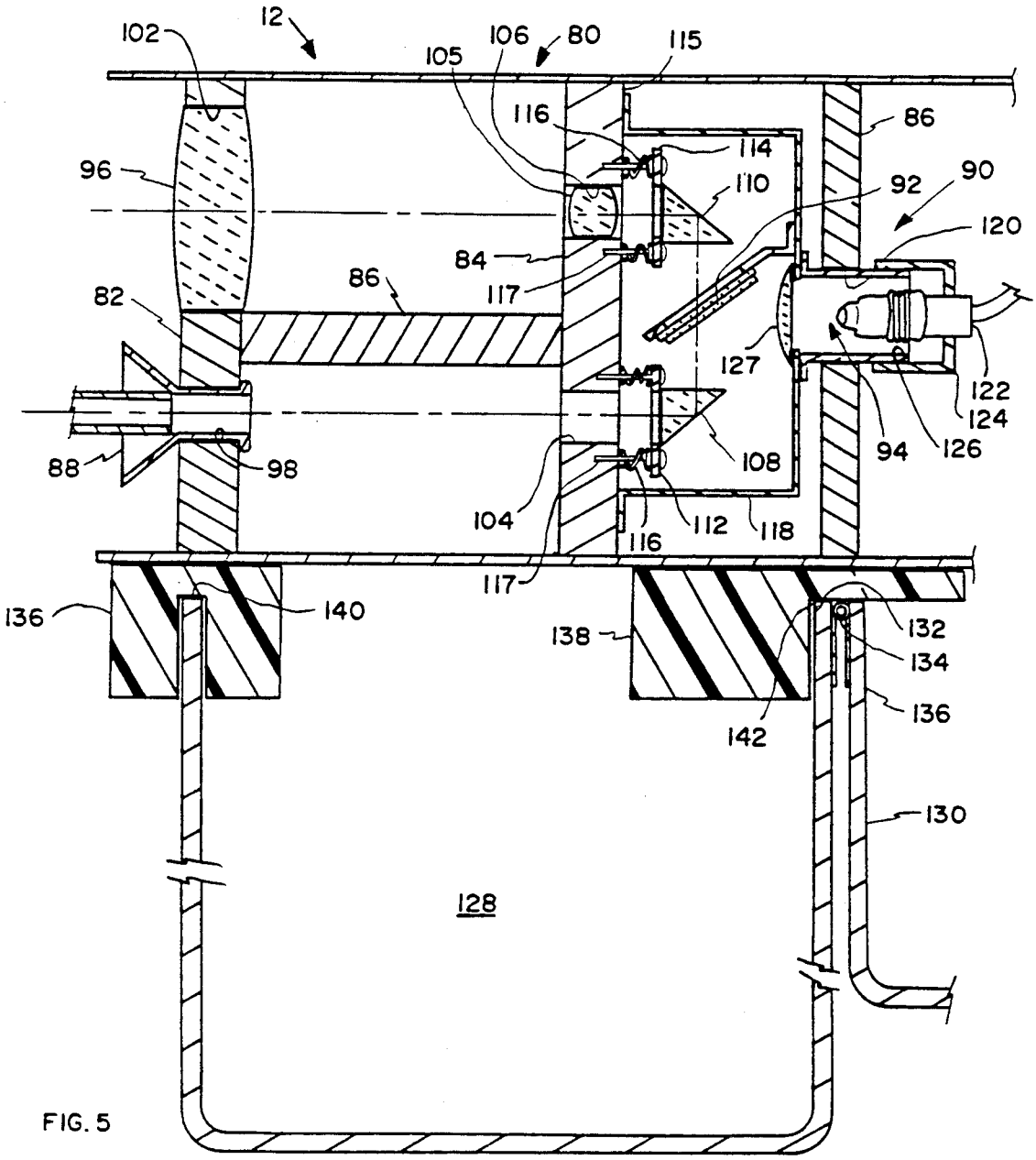
FIG. 5 is an elevational sectional view of another embodiment of the present invention.

FIG. 5 illustrates another embodiment of the present invention. In this embodiment, the boresight correlator 12 is shown to include a cylindrical housing 80 having a circular forward bulkhead 82, a circular middle bulkhead 84, and a circular rear bulkhead 86 mounted in spaced relation therein. A horizontally extending bulkhead support member 86 is secured between forward bulkhead 82 and middle bulkhead 84. Boresight correlator 12 is comprised of housing 80 and the associated bulkheads 82, 84, and 86, an alignment bezel 88, an optical assembly 90, a beam splitter 92, and an illumination source assembly 94. The housing and bulkheads may be made of PVC material, and the bulkheads may be secured to the cylindrical member by gluing, screws, etc.

The housing provides a packaging envelope for the bulkheads as well as an optical interface for optical sight 18 of the firearm and a mechanical interface for alignment of the firearm. The optical interfacing is provided by a primary lens 96 which is mounted in an opening 102 provided in forward bulkhead 82. The mechanical interfacing is provided by an alignment bezel 88 mounted in an opening 98 in forward bulkhead 82 below opening 102.

Middle bulkhead 84 is provided with a pair of spaced lower and upper openings 104 and 106 which are in axial alignment with openings 98 and 102, respectively, of forward bulkhead 82. A secondary lens 105 is mounted in upper opening 106 in axial alignment with primary lens 96. A pair of prisms 108 and 110 are respectively mounted in prism mounts 112 and 114 which axially align the prisms 108 and 110, respectively, with bezel 88 and prism lens 96. Each of the prism mounts are secured to the back side 115 of middle bulkhead 84 by compression springs 116 and screws 117.

A bracket 118 is mounted to the back side 115 of the middle bulkhead and extends therefrom for support of a beam splitter 92. The beam splitter is positioned between prism 108 and prism 110.

Illumination source assembly 94 is mounted in an opening 120 provided in rear bulkhead 86. Assembly 94 includes a light source 122 and supporting brackets 124 and 126. A collimating lens 127 is provided between illumination source assembly 94 and beam splitter 92.

To serve as a convenient means for transporting the correlator, a box 128 is provided. The box includes a top 130 secured to the upper portion 132 of the box by hinge assemblies 134 (only one shown). A pair of correlator support members 136 and 138 may be provided for supporting the correlator assembly on the edges 140 and 142 of the box. The correlator support members may be made of hard plastic or metal.

In the operation of this embodiment, boresight correlator 12 and firearm 10 are positioned as shown in FIG. 5. Muzzle end 22 of firearm 10 is inserted into alignment bezel 88 to be held therein by the magnetic attraction of the bezel. Illumination source assembly 94 is activated, and collimated visible light is directed to beam splitter 92 and into bore 20 of firearm 10. Scattered visible light from muzzle end 22, walls of bore 20, and chamber end 24 passes through prism 108, beam splitter 92, prism 110 and then through the secondary lens 105 and primary lens 96 to the sight mechanism of the firearm.

It is to be understood that although in the embodiments of the present invention prisms are disclosed as being used as the light receiving and directing means, turning mirrors may alternatively be resorted to, if desired.

It is to be also understood that the alignment fixture 14 as shown in FIG. 1 may be used with all of the embodiments of the present invention. In the embodiment of FIG. 5, fixture 14 may also be carried in box 128 along with the correlator.

It is to be further understood that the source of energy for the light source is not to be limited to the battery as described since an A.C. source may be resorted to, if desired.

We claim:

1. A device for boresighting a firearm having a barrel including a bore, a muzzle end, a chamber end, and sight means carried thereon, said boresighting device comprising:

a source of illumination; and an optical assembly disposed in spaced relation with said muzzle of said firearm and said source of illumination, said optical assembly comprising light receiving and directing means, a beam splitter intermediate said light receiving and directing means and said source of illumination, and collimating means mounted generally adjacent to said light receiving and directing means, said beam splitter disposed for directing said illumination into said muzzle, said bore, and said chamber for incident relation therewith and for directing reflected illumination therefrom and into said light receiving and directing means, said reflected illumination containing images of said muzzle, said bore, and said chamber, said collimating means including at least one lens disposed for directing said reflected illumination from said light receiving and directing means to said sight means, said sight means disposed for adjustment to provide coincident relation between said reflected and incident illumination.

2. A device as set forth in claim 1 wherein said at least one lens is defined as a first lens, and said collimating means includes said first lens and a second lens disposed generally adjacent to said light receiving and directing means.

3. A device as set forth in claim 2 including a housing for enclosing said source of illumination and said optical assembly, said housing including a pair of spaced openings, the first of said spaced openings disposed for receiving said muzzle end of said firearm, and the second of said pair of openings generally disposed in alignment with said sight means.

4. A device as set forth in claim 3 with said first of said openings being provided with a muzzle supporting bezel.

5. A device as set forth in claim 4 including support means for support of said light receiving and directing means in said enclosure for aligned relation thereof with said beam splitter, said support means including a bracket disposed for supporting said first and second collimating means in generally adjacent relation with said light receiving and directing means, including means for integrally supporting said light receiving and directing means and second lenses and said beam splitter.

6. A device as set forth in claim 5 wherein said source of illumination includes a light source, a battery connected to said light source for energization thereof, and switch means for connecting said battery with said light source.

7. A device as set forth in claim 6 including a third collimating means intermediate said light source and said beam splitter for directing a collimated beam of light to said beam splitter.

8. A device as set forth in claim 7 including an adjustable stock support means for support of the stock of said firearm in alignment with said first collimating means.

9. A device as set forth in claim 8 wherein said sight means is an adjustable optical sight carried on said barrel.

10. A device as set forth in claim 9 wherein said light receiving and directing means is a prism.

11. A device as set forth in claim 10 wherein said bezel is magnetic.

12. A device as set forth in claim 2 wherein said first and second lenses are respectively a plano concave lens and a plano convex lens.

13. A device as set forth in claim 2 wherein said first and second lenses are disposed generally in spaced axial relation adjacent to said light receiving and directing means.

14. A device as set forth in claim 2 including a housing enclosing said source of illumination and said optical assembly.

15. A device as set forth in claim 14 wherein said housing is provided with a pair of spaced openings, the first of said openings disposed for receiving said muzzle end of said firearm, and the second of said openings generally disposed in alignment with said sight means.

16. A device as set forth in claim 15 with said first of said openings provided with a muzzle supporting bezel.

17. A device as set forth in claim 4 wherein said housing includes a cylindrical member having a plurality of circular bulkheads in spaced, secured relation therein, a first of said plurality of circular bulkheads having said first and said second openings therein, said first opening disposed below said second opening, and said second opening having a primary lens therein.

18. A device as set forth in claim 17 wherein the second of said plurality of said bulkheads has a second pair of spaced openings, the first of said second pair of said spaced openings disposed in axial alignment with said first opening of said first bulkhead, and the second of said openings of said second bulkheads being in axial alignment with said second opening of said first bulkhead and having a secondary lens therein.

19. A device as set forth in claim 18 wherein said light receiving and directing means includes a first light receiving and directing member mounted to said second circular member in alignment with said first opening, and a second light receiving and directing member in alignment with said second opening of said second bulkhead, said first and second light receiving and directing member being respectively disposed in alignment with said first and second opening of said first bulkhead.

20. A device as set forth in claim 19 wherein said plurality of said circular members include a third circular member having a central opening therein, said light source being mounted in said central opening, and said beam splitter being mounted in angular relation between said light receiving and directing members and in alignment with said light source.

21. A device as set forth in claim 20 wherein said light receiving and directing members are right angle prisms.

22. A device as set forth in claim 21 wherein said bezel is magnetic.

* * * * *